US007950539B2

(12) United States Patent
Henriksson

(10) Patent No.: US 7,950,539 B2
(45) Date of Patent: May 31, 2011

(54) LOAD CONTROL DEVICE FOR A CRANE

(75) Inventor: Björn Henriksson, Västerås (SE)

(73) Assignee: ABB AB, Västerås (SE)

( * ) Notice: Subject to any disclaimer, the term of this patent is extended or adjusted under 35 U.S.C. 154(b) by 279 days.

(21) Appl. No.: 11/511,502

(22) Filed: Aug. 29, 2006

(65) Prior Publication Data

US 2007/0289931 A1 Dec. 20, 2007

Related U.S. Application Data

(63) Continuation-in-part of application No. PCT/EP2006/005843, filed on Jun. 14, 2006.

(60) Provisional application No. 60/694,436, filed on Jun. 28, 2005.

(51) Int. Cl.
*B66C 13/46* (2006.01)

(52) U.S. Cl. ..... 212/274; 212/270; 212/276; 356/139.1; 356/614

(58) Field of Classification Search ..... 212/270, 212/274, 276; 356/139.1, 614
See application file for complete search history.

(56) References Cited

U.S. PATENT DOCUMENTS

| | | | | |
|---|---|---|---|---|
| 4,281,342 | A * | 7/1981 | Ueda et al. | 348/94 |
| 4,784,420 | A * | 11/1988 | Makino et al. | 294/81.4 |
| 5,491,549 | A * | 2/1996 | Wichner et al. | 356/141.2 |
| 5,878,896 | A | 3/1999 | Eudier et al. | |
| 6,124,932 | A * | 9/2000 | Tax et al. | 356/614 |
| 6,145,680 | A * | 11/2000 | Jussila et al. | 212/274 |
| 6,182,843 | B1 * | 2/2001 | Tax et al. | 212/274 |
| 6,229,473 | B1 * | 5/2001 | Doemens et al. | 342/59 |
| 6,234,332 | B1 * | 5/2001 | Monzen et al. | 212/275 |
| 6,256,553 | B1 * | 7/2001 | Erikkila | 700/213 |
| 6,351,720 | B1 * | 2/2002 | Hoshina et al. | 702/154 |
| 7,040,496 | B2 * | 5/2006 | Hakala | 212/274 |
| 7,123,132 | B2 * | 10/2006 | Heidenback et al. | 340/431 |
| 7,137,771 | B2 * | 11/2006 | Maurer et al. | 414/334 |
| 7,331,477 | B2 * | 2/2008 | Schulte et al. | 212/270 |
| 2002/0024598 | A1 * | 2/2002 | Kunimitsu et al. | 348/159 |
| 2004/0026349 | A1 * | 2/2004 | Colgate et al. | 212/284 |
| 2005/0016005 | A1 * | 1/2005 | Voecks | 33/344 |
| 2005/0281644 | A1 * | 12/2005 | Lussen et al. | 414/403 |

FOREIGN PATENT DOCUMENTS

| | | | |
|---|---|---|---|
| JP | 20011322796 | A | 11/2001 |
| JP | 2003267660 | A | 9/2003 |
| WO | 92/19526 | * | 4/1992 |
| WO | WO-92/19526 | A | 11/1992 |

OTHER PUBLICATIONS

PCT/ISA/210—International Search Report—Oct. 6, 2006.
PCT/ISA/237—Written Opinion of the International Searching Authority—Oct. 6, 2006.
PCT/IPEA/409—International Preliminary Report on Patentibility—May 30, 2007.

* cited by examiner

*Primary Examiner* — Thomas J Brahan
(74) *Attorney, Agent, or Firm* — Venable LLP; Eric J. Franklin

(57) ABSTRACT

A control device and system for controlling a suspended load of a container crane with a trolley, a spreader and load lines arranged in a four point suspension for lifting a load and an optical sensor for sensing a deflection position of an orthogonal axis of a container suspended under the spreader. Two or more actuators are arranged attached to at least one load for moving at least one said suspension point closer to or farther away from an imaginary center line by shortening and/or lengthening the at least one load line.

44 Claims, 7 Drawing Sheets

LOAD CONTROL DEVICE FOR A CRANE

CROSS-REFERENCE TO RELATED APPLICATIONS

This application is a continuation-in-part of PCT/EP2006/005843 filed 14 Jun. 2006, which claims priority to U.S. provisional patent application 60/694,436 filed 28 Jun. 2005.

TECHNICAL FIELD

The invention relates to a device and a method for transferring freight containers. The invention concerns a device and a method for moving a container by means of a crane such that the position and movement of the container or spreader is controlled accurately while transporting, picking up or landing a container or empty spreader. In particular it is a system and a method to measure and control displacement and oscillations of the container about one or more orthogonal axes of the container.

BACKGROUND ART

A great and growing volume of freight is shipped around the world in standard shipping containers. Transshipment has become a critical function in freight handling. At each point of transfer from one transport means to another, from ship to shore in ports and harbours for example. There is usually a tremendous number of containers that must be unloaded, transferred to a temporary stack, and later loaded on to another ship, back onto the same ship or loaded instead onto another form of transport. Loading and unloading containers to and from a ship takes a great deal of time. The development of automated cranes has improved loading and unloading and made the productivity more predictable, and also eliminated many situations in which port workers have been exposed to danger and injury.

The technical demands of handling containers accurately are great. A container may be handled by a stationary crane or by crane moving on rails or moveable in any other way. Each crane has a lifting device usually incorporating a spreader of some kind that directly contacts a container, to grip it, lift it, lower it and release it. In this description the term spreader is used to denote a part of a lifting device that is in direct contact with a container. Spreaders are normally designed to handle more than one size of container, for example 20-40 ft or 20-40-45 ft long containers. The spreader is suspended from the boom of a crane from a moveable device known as a trolley, which moves along the boom of the crane, in a direction usually referred to as the X direction. The position of the trolley is measured and/or calculated during operations. The position of the spreader and the container underneath it may be monitored by use of a camera observing a light source or marker on the spreader. It is of great importance for accurate operation, and especially for automatically controlled operations, that the position of the container is accurately known during pick-up and during landing of a container.

Accuracy during pick-up is necessary for the spreader to grip the container properly at the first attempt. Accuracy during landing is important not only to land the container at the first attempt, but also because if an error in stacking containers one on top of each other that can lead to a cumulative error which may be unacceptable. When a 5-high stack of containers is not stable it presents a potential for containers to be damaged. An unstable stack also demands greater ground area and more clearance space around it for lifting operations.

Cranes may be operated automatically in many phases of each operation. However a crane operator is usually required to drive the crane to deal with situations that are not handled by existing automated operations. For example, when a container is lowered for landing there is often a torsional movement of the container, known as a skew. With a skew problem, when the long axis of the container swings around a vertical axis in a skew (torsional) direction, it can take many seconds, perhaps up to a minute, before the skew oscillations die down enough for the container to be lowered on to a truck, container or other target. The container cannot be landed accurately if it is not accurately lined up above the landing target. When unloading a ship with perhaps many hundreds of containers, the cumulative effect of unloading time lost due to skew oscillation is considerable. Manual adjustments may be made by the crane operator to cancel out a skew moment by steering the spreader against the moment or by operating auxiliary adjustment devices. However the effectiveness of manual intervention is operator dependent and does not reliably reduce the time lost to skew oscillation.

Application JP2001322796 entitled Vibration control device for a load, to Mitsubishi, describes a device suspending a conventional spreader fitted with four tension sensors to measure rope tension in the load ropes. A tension sensor is fitted to each lifting rope near a point where the rope is fixed, arranged so that there are two sensors on one side of the spreader and two on the other side. At the non-fixed end two main winding drums are arranged for lifting the load, to wind in or wind out, so as to lift, lower the container. A skew cylinder mechanism is arranged connected to sheaves arranged on each side near the winding drums so as to exert a greater tension force on the load ropes on one side of the spreader and a corresponding lesser tension on the load ropes on the other side of the spreader, so as to counteract an error in skew angle. Measurements of rope tension on each end of the container are compared. A skew angle θ (theta) is calculated from the measurements of rope tension combined with calculations of a distance between trolley and spreader based on measurements of the rotational frequency and angle of rotation of the winding drums. An online automatic translation of the description of JP2001322796 explains that use of tension sensors provides a way to detect skew which may be better than more expensive optical means. However, the described device depends on comparable measurements of tension for each end of the container which makes the device liable to error in cases where weight distribution inside the container is uneven and one end of the container is heavier than the other. It is also somewhat problematic to rely on tension sensors normally of the load cell type. These are usually large and heavy analogue devices that require calibration at frequent intervals to maintain the level of relative accuracy such load cells can provide. Similarly, the abstract of JP10017268, to Mitsui, entitled Skew swing preventive method and device of crane suspending cargo, describes a device that includes the use of tension sensors in the load ropes. Optical detection means for determining a skew angle are also described. This device or system uses measurement of tensile forces in the lifting ropes, together with measurement of angular velocity and skew angle by means of a CCD camera, to find or calculate an angular skew error and a skew oscillation period. A natural oscillation period is calculated from a calculated moment of inertia by a computer for the hanging container. Rope tension is then applied to one or other end of a loading rope by means of an actuator arranged at each end of each loading rope. The driving force required by the actuator is reduced by the directional changes of the loading ropes and addition of extra sheaves, and tension balancing sheaves, so that the load of the hanging container does not act directly on the actuators. A computer is used to apply counter tension by means of actuators mounted on both sides of the trolley until the skew error is found to be zero. However, like JP2001322796 (above) the described system relies principally on measurements of rope tension. Rope tension is also influenced by forces other than a diagonal or skew movement of the container, including forces due to uneven weight distribution in the container. Rope tension is more of measure of some of the forces acting on a container rather than a direct measure of container position. Accurate measurement of angular velocity of rotation using a camera may be somewhat difficult in practice, especially when the angular/rotational velocity of a container varies, or is combined with other non-skew movements. Accuracy of load cells as tension sensors tends depends on calibration at intervals. A disadvantage with this approach is that although calculations may be carried out to compensate for skew angle error due to stretching of the ropes under load, spreader-load calculations based on a dynamically changing rope tension may include errors that are hard to predict and thus difficult to compensate for.

As well as skew deflection in which the long orthogonal axis of the container rotates or oscillates, the short side of the container may be displaced or may oscillate, giving rise to a movement about the long orthogonal axis of the container, a movement called a list. This may be caused by inertia during acceleration, uneven winds etc, or uneven loading inside the container, or a combination. When the short axis of a container is deflected or rotated about the long axis in a list movement then one long edge of bottom of the container is lower than the other. When a container is listing the actual position of the bottom of the container may not be predicted accurately. A consequence of this is that the bottom of the low side of the container will touch down inaccurately, sometimes by up to 10-25 centimeters or so away from the intended target. Such inaccurate placement gives rise to an unstable or even dangerous stack when containers are stacked in piles of 5 high. It means that manual intervention by the crane operator is necessary to maneuver the container to solve the problem of inaccurate landing due to a list of the container.

There is a similar and third type of container deflection which can arise during loading or unloading in which one end of the long axis of the container may hang down lower than the other end, a movement, displacement or deflection called trim. A trim problem can occur for example when loads inside a container are unevenly distributed, so that when lifted, one end container tends to hangs down lower than the other. This type of error can also lead to inaccurate loading or stacking, as the position of the ends of a container with a trim error are not directly vertically underneath the spreader, and thus not accurately predicted. A trim error can also cause errors of position during landing and usually requires manual intervention by the crane operator to prevent causes error in placement of containers, for example on a truck and in the stacking of containers, for example in a yard or on a ship.

SUMMARY OF THE INVENTION

The aim of the present invention is to remedy one or more of the above mentioned problems. This and other aims are obtained by a load control device, a method and a system according to the present invention.

According to an embodiment of the invention the load control device comprises a trolley, spreader and load lines arranged in a four point suspension for lifting a load and an optical sensor for sensing a deflection position of an orthogonal axis of a container suspended under the spreader and wherein two or more actuators are arranged attached to at least one load line, Wherein two or more said actuators are arranged for moving at least one said suspension point closer to or farther away from said imaginary centre line ($X_L$, $Y_W$, $V_H$) by shortening and/or lengthening the at least one load line, and a sensor means is arranged on at least one said actuator for detecting actuator position, and thereby measuring any change of length of the at least one load line.

According to another embodiment of the invention the load control device comprises at least one actuator comprising a screw drive powered by a motor arranged so that the actuator pulls or releases a load line so causing the load line to move in a substantially straight line. The actuator preferably further comprises a screw device arranged for linearly extending or withdrawing a shaft arranged attached to a load line at the end of the crane farthest from the motor house.

According to another embodiment of the invention the load control device comprises an optical sensor arranged in line-of-sight of two or more light sources arranged on the spreader in a first straight line relative to an orthogonal axis of the container. Preferably the light sources are active light sources such as IR emitting diodes or the like, but they may also in some part comprise passive sources such as reflectors, markers, high-contrast patterns.

According to another embodiment of the invention the method comprises determining a linear position of at least one actuator of the load control device, and sending a signal to at least two said actuators to draw in and/or reel out at least one load line in order to move at least one said suspension point closer to or farther away from a said imaginary centre line.

According to another embodiment of the invention the method comprises continuously determining a position of at least one actuator by use of a sensor means. The sensor means preferably provides a digital out-signal to facilitate continuous or high frequency monitoring.

According to another embodiment of the invention the method comprises comparing a first actuator position and actuator movement limits with at least one second actuator position and movement limits and determining which actuator or actuators shall be moved to correct a linear displacement error causing an error of skew, list and/or trim.

According to another embodiment of the invention the method comprises measuring with the optical sensor a distance to two or more light sources arranged in a first straight line on the spreader and measuring any linear deviation from the orthogonal axis in an X or Y direction. In another embodiment the method comprises measuring with the optical sensor a distance to at least one third light source, preferably arranged on a line perpendicular to the first straight line. Measurement of distance to the third light source provides measurement of any vertical displacement from the orthogonal centre lines that may cause a container to list or to have a trim error.

Another object of the present invention is to provide an improved computer program product and a computer readable medium having a program recorded thereon, for controlling a load control device of a crane.

In addition, further and advantageous aspects of the invention are described in relation to an independent claim for a graphical user interface. This invention claims priority from an application U.S. 60/694436 which is hereby incorporated in this specification in its entirety by means of this reference.

The main advantage is that load control device and the system enables fast recovery from a skew error. This has the result that delays due to swinging and oscillation of a suspended loading during unloading are minimised. The use of absolute encoder type sensors give a continuous linear position readout on the actuators, so that a faster response than prior art systems is made possible. This is also an advantage when dealing with faster acting forces, for example if there is a sudden gust of wind, or a shift in the load inside a container, and the like. It also enables recovery from list error or trim error and any or all three recovery methods and actions may occur at the same time.

Another advantage is that correction of skew or list or trim errors provide for accurate positioning for a container to be landed, on a truck for example. The optical transmitters and CCD cameras of the preferred embodiment function with reliable accuracy in all weathers, thus providing dependable throughput in respect of automatic lifting and landing of containers. Finally, the system is not restricted to any particular STS crane type or manufacturer, but may be fitted or retrofitted to any new or existing crane.

BRIEF DESCRIPTION OF THE DRAWINGS

A more complete understanding of the method and system of the present invention may be had by reference to the following detailed description when taken in conjunction with the accompanying drawings wherein.

DESCRIPTION OF THE PREFERRED EMBODIMENTS

Figure 1:
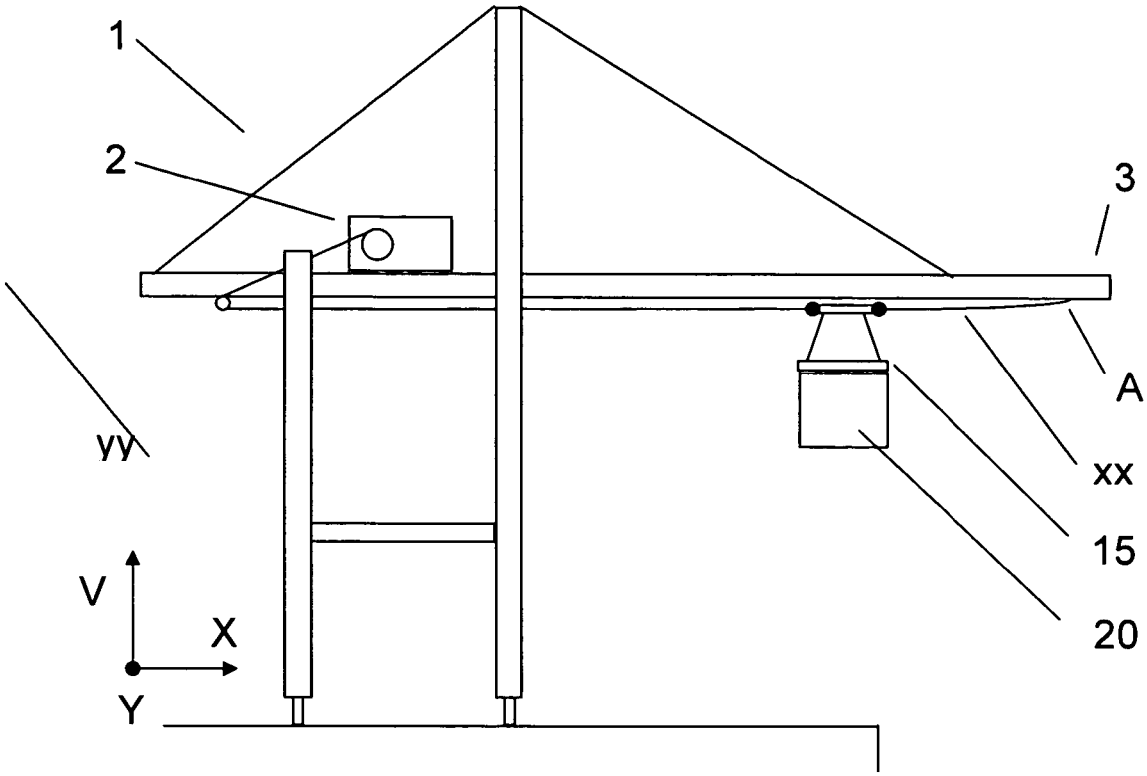
FIG. 1 shows in a schematic diagram a simplified arrangement for a ship-to-shore (STS) crane.

FIG. 1 shows a simplified schematic diagram of a ship-to-shore (STS) crane 1 arranged on a quayside for loading or unloading containers from a ship. The motor house mounted on the boom of the crane is arranged with main lifting motors and winding drums 2 which reel in or reel out ropes or load lines for lifting or lowering a container 20. The main lifting action takes place between the sheaves nearest the motor house and the boom tip 3 indicated as one end of the boom. Container 20 is held by a spreader 15 suspended from a trolley 21 which moves in the direction of arrow X forward (+ve) and back (−ve) along the boom. The load lines arranged on trolley 21 are also connected to actuators A (16-19) arranged at or near the tip 3 of the boom. The actuators, spreader, trolley and load lines are shown in more detail in FIG. 2.

Figure 2:
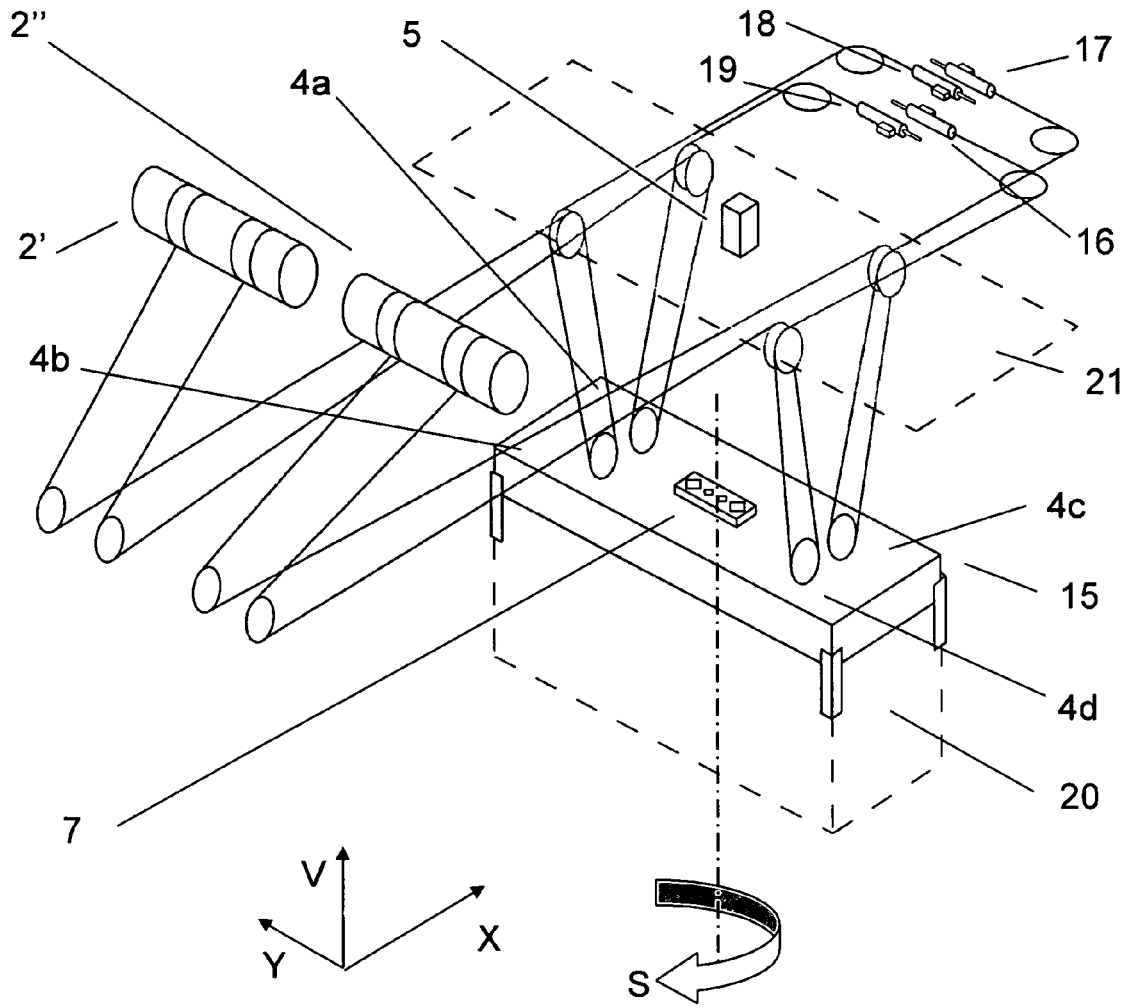
FIG. 2 shows a diagram of positional error of skew, trim and list with respect to the orthogonal axes of a container.

FIG. 2 shows an arrangement according to an embodiment of the invention. The figure shows the container 20 held by a spreader 15 suspended from a trolley 21. The container is lifted and lowered by main winding drums 2, housed in the motor house (FIG. 1). On the other side of the container nearest the tip of the boom the load lines are arranged with actuators 16-19 which lengthen or shorten the load lines at that point. The spreader 15 is suspended from the trolley by load lines arranged at four points generally corresponding with the corners of the spreader 4*a*-4*d*. Trolley 21 is arranged with a sensor 5, preferably a CCD camera, which is aimed down at an optical target 7, which comprises two or more targets 8, 9 which preferably are light sources.

Figure 3:
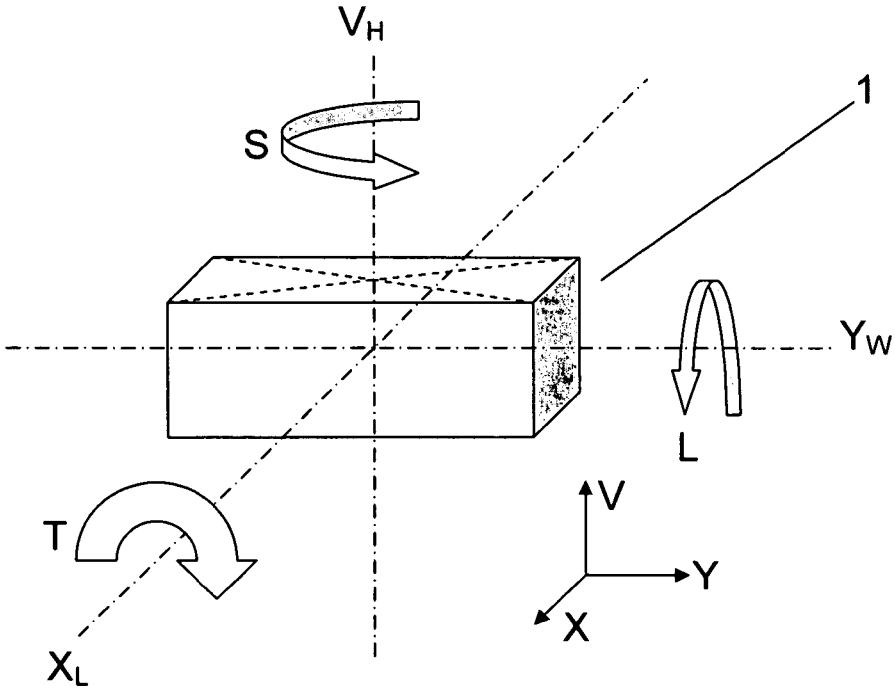
FIG. 3 shows a layout for a load control device according to an embodiment of the invention.

FIG. 3 shows three principal orthogonal axes with respect to a container 20, and shows three imaginary centre lines for the container with respect to the orthogonal axes. The figure also shows diagrammatically a skew error S as a rotation about a vertical axis $V_H$, a list error L with which a container tends to list around its long axis and rotate about the axis $Y_W$, and a trim error T with which one of the ends of the container along the long axis hangs lower, shown as a rotation about the imaginary centre line axis $X_L$.

Figure 4:
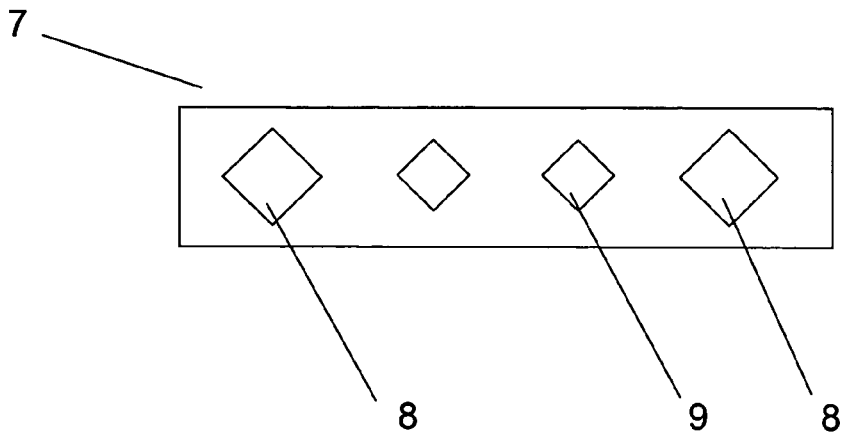
FIG. 4 shows schematically an optical target, such as an optical transmitter comprising two or more light sources.

FIG. 4 shows a light source 7. This comprises at least two light sources, which are preferably arranged as two large light sources 8, and two smaller sources 9. Measurements of two smaller light sources may be discarded when the spreader is very low, ie is at a great distance from the trolley. Correspondingly measurements of two larger light sources may be discarded when the spreader is close to the trolley (when the spreader is high).

The load control equipment consists of one CCD camera 5 and at least two of a plurality of optical transmitters 8, and/or 9. Optical transmitters 8 and 9 are of different size or light intensity. The CCD camera 5 is mounted under the boom preferably on the trolley, and the optical targets are mounted on the spreader. Thus an optical target (comprising at least two optical targets) aligned with the spreader moves as the container moves, and is arranged in a clear line of sight from camera 5. Measurements from camera 5 are taken continuously and distances calculated between the trolley and the spreader. For example when the spreader has a skew error and is rotated around its vertical axis V in the direction S of FIGS. 2, 3, then the spreader is positioned at an angle to orthogonal direction Y which, in concrete terms, means that at least one corner 4*a*-4*d* of the container has a distance error and is positioned too far from the boom tip and at least one other corner has a position error and is to close to the boom tip. To correct a distance error one or more actuators 16-19 are controlled so as to drive a load line, and thus a corner of the spreader 4*a*-4*d*, towards or away from the boom tip. In the case of a skew error a pair of actuators arranged on load lines and corresponding to the same X-direction side of the container are applied. For example actuator 18 can reel out a load line and 19 reel in to move corner 4*a* nearer to the tip of the boom. Similarly or as well, 16 could be reeled out and 17 reeled in to move corner 4*c* further away from the boom tip.

Preferably in of a pair of actuators 16 and 17, (or 19 and 18) the load line is reeled in by one actuator and reeled out by the other actuator by the same amount, same distance, to correct a linear error due to skew. The distance from the trolley to each of the optical targets on the spreader is measured, and the position of the optical targets relative an orthogonal axis is measured, so that one or more linear errors of position in an X or Y direction are calculated. When a linear error, such as a skew-type error, has been determined by measurement the actuators are moved a calculated distance in a linear direction to lengthen and/or shorten load lines arranged at one or more corners 4*a*-4*d* of the spreader. In this way the spreader is directly moved in a chosen linear direction by a measured amount by controlling the actuators, in order to minimize a measured or a measured and calculated linear error of spreader position.

In order to provide accurate error and fast correction the relative position of the spreader must be determined accurately and continuously. A continuous measurement means on one or more actuators is used to determine the position of each actuator at all times. An optical absolute encoder is preferred, such as the type in which the measuring system consists of a light source, a code disc mounted in a precision bearing and an opto-electronic scanning device. A light source, preferably an LED, illuminates the code disc and projects a pattern known as a track on the code disk onto the opto-array. At every position as the code disk rotates disk the opto-electronic array is partially covered by the dark track markings on the code disk. The light source transmitted through the code disk is interrupted and the code on the disc is transformed in the opto array into electronic signals. If necessary, fluctuations in the intensity of the light source may measured by additional components and/or photo-transistors. The electronic signals are then amplified, converted and output for evaluation. One or more single turn encoder suitably positioned may be used, and a best mode may be practiced using a multi-turn encoder. The multi-turn encoder may be used because more than one turn of the actuator shaft may be expected during an adjustment of the length of the load rope or load line. A multi-turn encoder may comprise several single turn encoders coupled together using a means such as a reduction gear.

Figure 8:
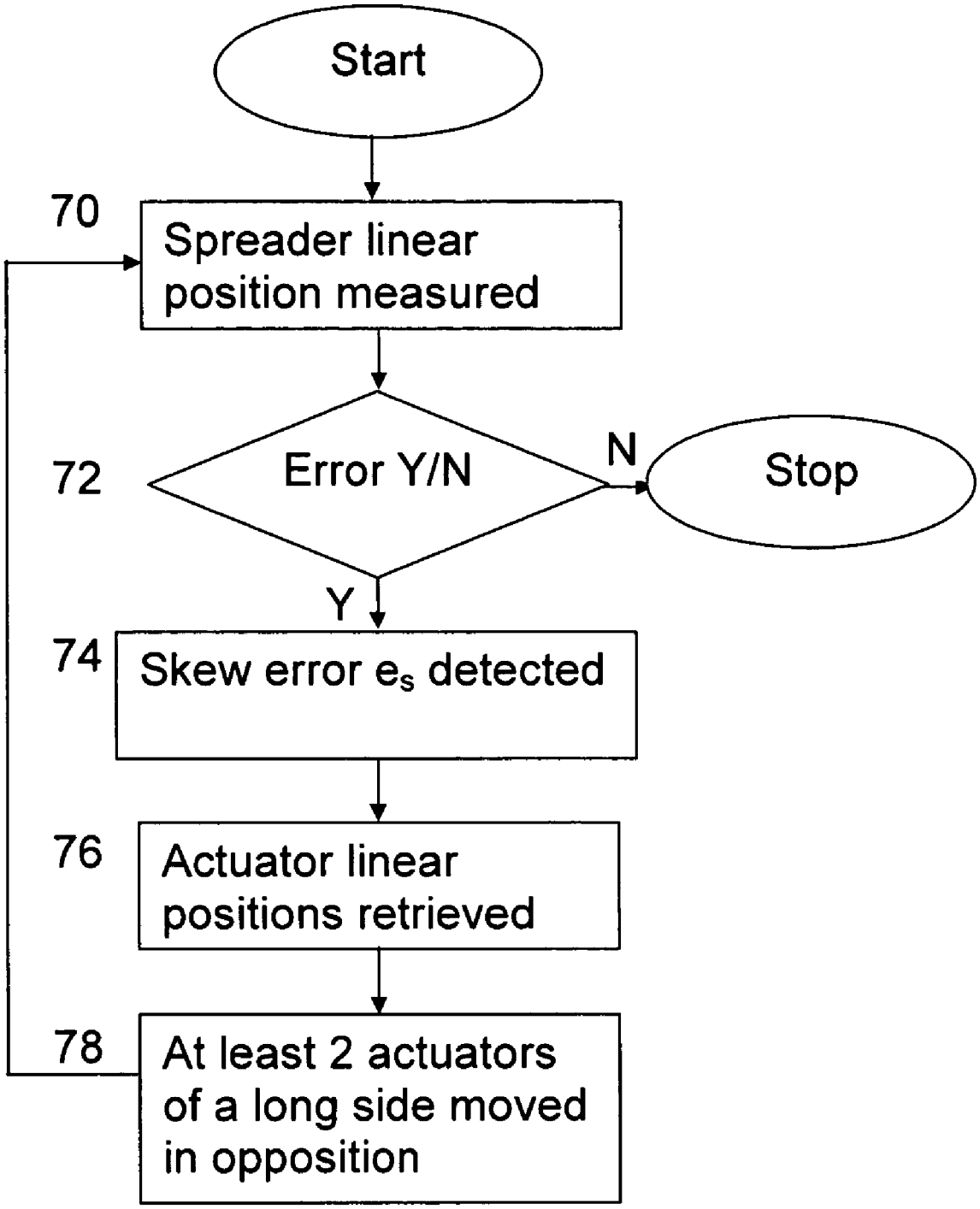
FIG. 8 shows show schematically a flowchart for a computer program to carry out a method according to an embodiment of the invention to rectify a skew-type error, FIG. 9 a flowchart for a computer program to operate a method to rectify a list error and FIG. 10 a flowchart for a computer program to operate a method to rectify a trim error.

FIG. 8 shows a flowchart or block diagram describing the steps that a computer program may execute in order to make a computer or processor carry out a method for load control according to an embodiment of the invention. Distance from the trolley to the spreader is measured 70, preferably continuously. When spreader position deviates from a predetermined position under the trolley, a linear deviation is calculated. If the linear deviation is determined to be a skew error, $e_s$ then the present positions of the actuators is checked and at least one pair of actuators, such as 18 and 19, or 17 and 16, is moved 78. Which is to say that in the case or a rotated error, a skew error, one actuator of each pair reels out and the other one reels in. This pulls at least one corner of the spreader in a linear direction to reduce the error. This is best achieved by sending a signal of the same magnitude to each actuator of the selected pair, but of a different sign. Thus each actuator is driven over the same distance but in opposite directions. Measurements by the camera continue and when the present skew error has gone to zero, or another predetermined value, the movement by actuators for load control position stops. The combination of actuators used to correct a linear error in a skew direction is as described that each actuator pair parallel with the same long side moves, but in opposite directions. This may be summarized in a table form as:

| Pair | Pair | Skew error |
|---|---|---|
| 18, 16 | 19, 17 | Error direction |
| Reel out | Reel in | + |
| Reel in | Reel out | − |

In contrast to the opposed movement of specific actuators for a skew error, above, a list error for a container is corrected by application of each actuator pair parallel with the same long side moving (reeling out or reeling in) in the same direction:

| Pair | Pair | List error |
|---|---|---|
| 19, 16 | 18, 17 | Error direction |
| Reel in | Reel out | + |
| Reel out | Reel in | − |

A trim error is remedied by applying each actuator pair corresponding to each short side moving (reeling out or reeling in) in the same direction:

| Pair | Pair | Trim error |
|---|---|---|
| 17, 16 | 18, 19 | Error direction |
| Reel in | Reel out | + |
| Reel out | Reel in | − |

Figure 7:
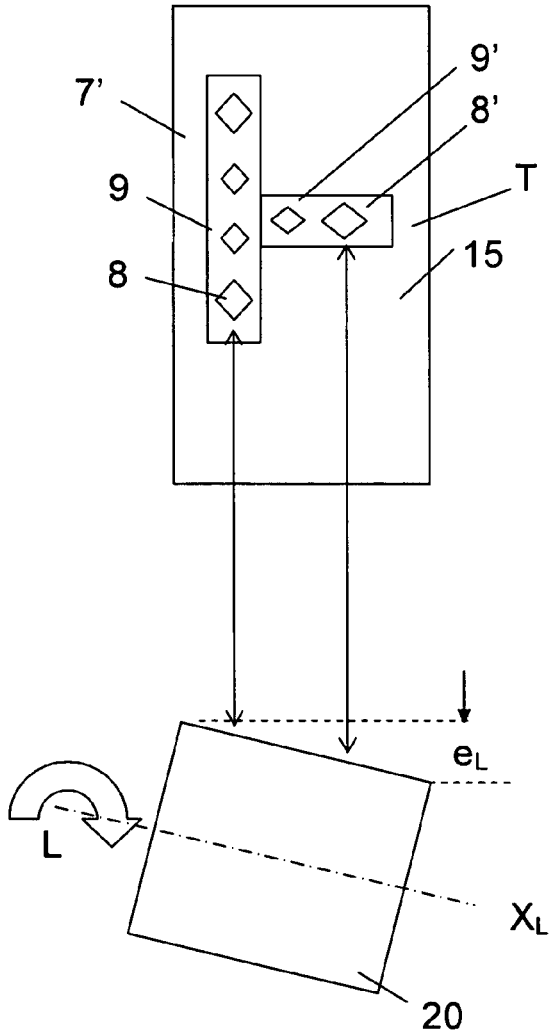
FIG. 7 shows an arrangement of the developed optical target on a container and in relation to a list error.
Figure 5:
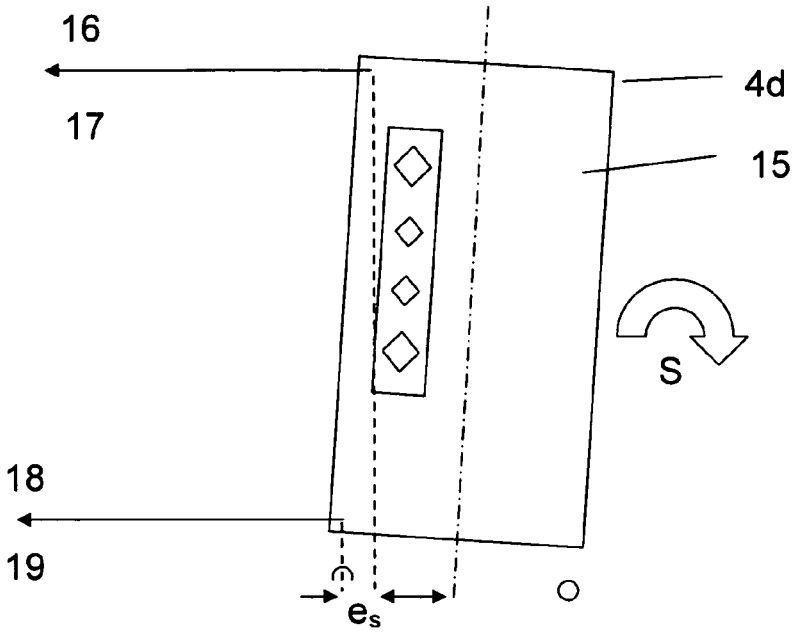
FIG. 5 shows the arrangement of the optical target on a container and in relation to a skew-type position error.

FIG. 7 shows a list error, in which one side of the container is rotated below the centre line by a linear distance of $e_L$ The corrections for errors of any of a skew, trim or list type may be applied together of subsequently. Preferably the trim or list correction is applied at a slower rate, using a lesser signal amplification in a proportional P-type loop.

Figure 9:
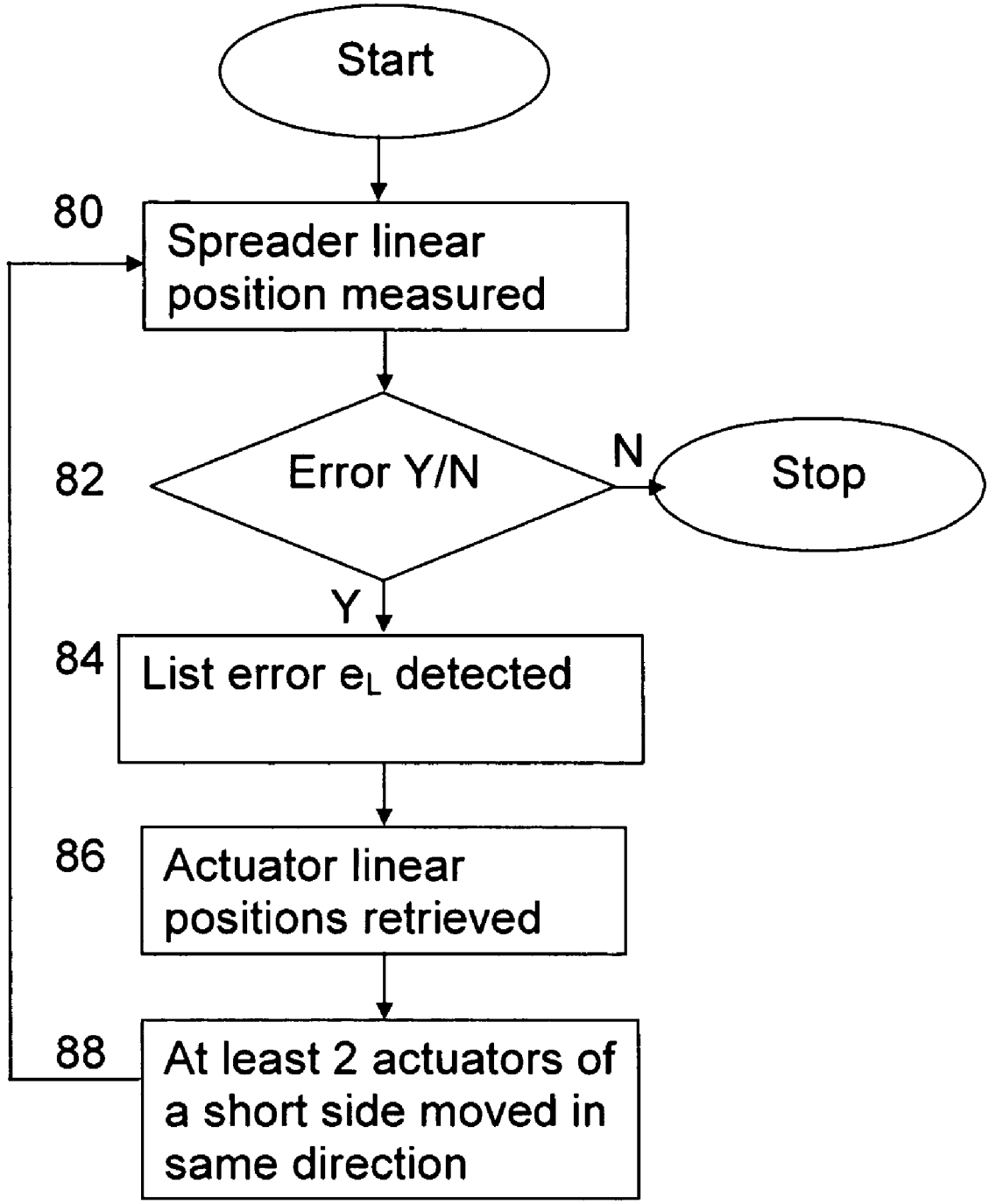
Figure 10:
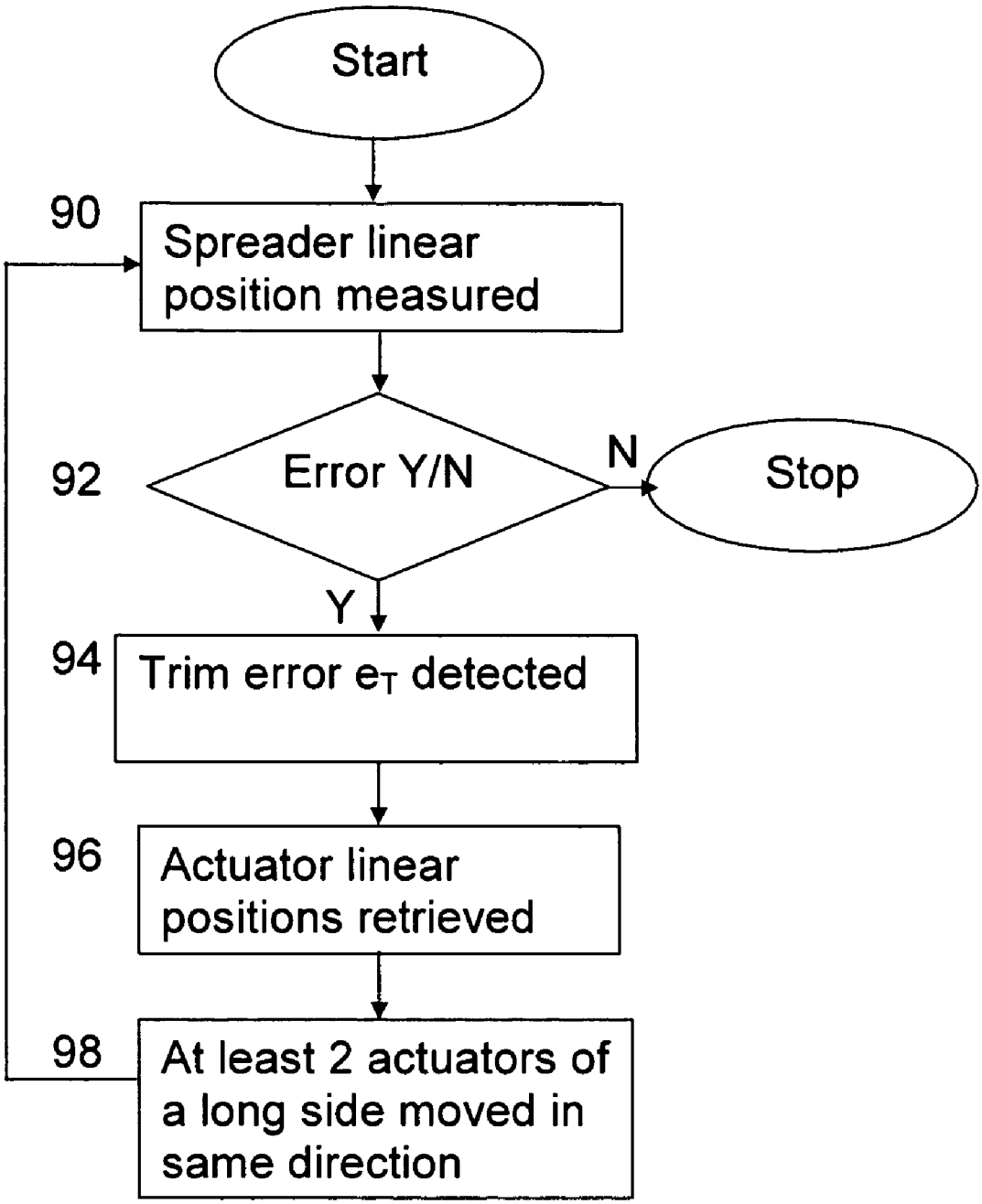

FIG. 9 and FIG. 10 each show a similar flowchart for a computer program to control as that shown in FIG. 8, for skew correction. FIG. 9 for correcting a trim error specifies in contrast to the skew method shown in FIG. 8 that the at least two actuators corresponding to the same long side of a spreader, eg 4*a*-4*c* or 4*b*-4*d*, both of them move in the same direction, +ve or −ve. The skew correction method mapped in FIG. 8 points out that actuators move in opposition, ie one +ve and the other of the pair −ve. FIG. 10 shows a flowchart for correcting a list error. The actuator pairs also move in the same direction, in this case each pair corresponding to the short sides, ie 4*a*-4*b* and/or 4*c*-4*d*.

In the preferred embodiment, at least one camera member is a CCD camera. However other optical instruments may also be used, such as a laser scanner or laser range finder. In the preferred embodiment at least one optical target is an Infra Red (IR) transmitter. However other optical targets may be provided, such as: LCD diodes, fluorescent lamps or reflective targets such as reflectors, markings, patterns or high contrast surfaces on the spreader.

Figure 6:
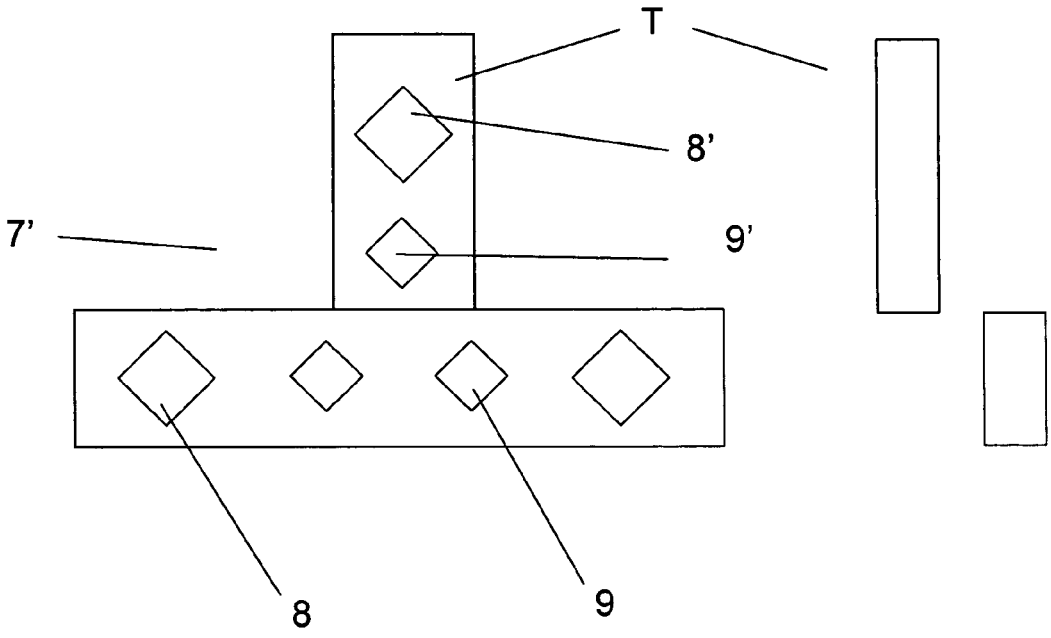
FIG. 6 shows a development of the optical target according to another embodiment of the invention.

In another preferred embodiment the light source 7 comprises optical targets arranged in two directions. A T-shaped or even cross shaped arrangement of light sources may be used. In particular for measuring a list error, one part of the arrangement, such as 7' of FIG. 4, 6 has a part T which may be arranged at a different height to the main linear part, as shown by the side elevation elements of FIG. 6. The difference in height between the main light sources and the light sources of the T part enable the CCD camera scanning to measure the list error more accurately because the vertical distance between the first light sources and the light sources of the T shape are already known, and deviations In another embodiment an incremental encoder may be used as a simpler and cheaper sensor for finding actuator position. Preferably an incremental encoder or a combination of incremental encoders are used in situations where re-starts or re-configurations due, for example, to unexpected power loss or error situations are extremely rare.

One or more microprocessors (or processors or computers) comprise a central processing unit CPU performing the steps of the methods according to one or more aspects of the invention, as described for example with reference to FIGS. 3-7.

The comparator may be comprised as a processor, or it may be comprised as a standard computer or processor or other device or a dedicated analogue or digital device or on one or more specially adapted computers or processors, FPGAs (field programmable gate arrays) or ASICs (application specific integrated circuits) or other devices such as simple programmable logic devices (SPLDs), complex programmable logic devices (CPLDs), field programmable system chips (FPSCs). The method or methods, such as those described in relation to the figures, especially to FIGS. 4-7, are performed with the aid of one or more computer programs, which are stored at least in part in memory accessible by the one or more processors.

The computer program comprises computer program code elements or software code portions that make the computer, processor or other device perform the methods using equations, algorithms, recursive algorithms, wireless communications parameter data, stored values, calculations and statistical or pattern recognition methods previously described, for example in relation to FIG. 1 and FIGS. 8-10.

A part of the program may be stored in a processor, but also or instead in a ROM, RAM, PROM, EPROM or EEPROM chip or similar memory means. The program in part or in whole may also be stored locally (or centrally) on, or in, other suitable computer readable medium such as a magnetic disk, CD-ROM or DVD disk, hard disk, magneto-optical memory storage means, in volatile memory, in flash memory, as firmware, or stored on a data server. Other known and suitable media, including removable memory media such as Sony memory Stick™ and other removable flash memories, hard drives etc. may also be used. The program may also in part be supplied from a data network, including a public network such as the Internet. The computer programs described may also be arranged in part as a distributed application capable of running on several different computers or computer systems at more or less the same time.

A graphical user interface (GUI) may be used to display one or more of the values obtained using the system and methods described above during the calculation of the position of the load of the crane. In a simple form, one or more readouts of parameters for the present container load such as speed in an X (or Y) horizontal direction, speed in a vertical direction are displayed on a screen in numerical and/or graphical representations. In particular, one or more such GUIs may be used to display relative positions of crane 1, load 15 and landing or lifting target relative to a real or graphical representation of the crane, load, landing position, truck etc in a part of a freight yard or container port. A selection action such as right-click with a computer mouse, or other computer input/selection member, on parts of the representation of the GUI may result in a display of any of: live real-time values for displacement errors of trim, list or skew type, or list or trim or visual representation of container orientation; stored values for errors in load position; configuration screens where it is possible to set or change predetermined values used in the determination of a position error, determination of a skew or list or trim error, calculation of load position. In one development of the GUI, one or more parts of the GUI may be combined on a screen together with a display of part of the operations provided by a video camera. Thus one or more parts of the GUI may be provided to give a visual readout which is superimposed over live pictures of the lifting or landing operations. In other words one or more graphical and/or numerical values for load position, trim error, list or skew error etc. may be superimposed on a live video picture while the load is being handled.

It should be noted that while the above describes exemplifying embodiments of the invention, there are several variations and modifications which may be made to the disclosed solution without departing from the scope of the present invention as defined in the appended claims.

The invention claimed is:

1. A load control device for controlling movement of a suspended load of a container crane, said crane comprising a trolley, a spreader and load lines arranged in a four point suspension for lifting a load, the load control device comprising:

at least one light source array arranged on the one spreader, the at least one light source array comprising a plurality of light sources extending in at least one direction on the spreader;

an optical sensor arranged on the trolley to detect light produced by the at least one light source and thereby movement deflection of a position of an orthogonal axis of a container suspended under the spreader relative to an imaginary center line of the orthogonal axis of the container, wherein the movement deflection is determined based upon differences in the detection by the optical sensor of the light produced by the light sources, wherein the optical sensor is arranged in line-of-sight of two or more light sources of the light source array arranged on the spreader in a first straight line relative to an orthogonal axis of the container, wherein the optical sensor is also arranged in line of sight of at least one third light source arranged on a line which is perpendicular to the first straight line, and wherein the at least one third light source is arranged at a different height to the light source of the first straight line; and at least two actuators attached to at least one load line, wherein at least two of the actuators are arranged to move at least one of the suspension points closer to or farther away from the imaginary center line by shortening and/or lengthening the at least one load line.

2. The device according to claim 1, wherein at least one first actuator is arranged to reel in one first part of a first load line and, at the same time, at least one second actuator is arranged to let out one second part of the first load line.

3. The device according to claim 1, wherein at least one said actuator comprises a device arranged for movement in a forward or reverse direction for reeling in or letting out part of a load line.

4. The device according to claim 3, wherein at least one said actuator comprises a device arranged for movement in a straight line in a forward or reverse direction.

5. The device according to claim 1, wherein at least one actuator comprises a screw drive powered by a motor for moving at least one load line in a substantially straight line.

6. The device according to claim 5, with at least one said actuator that comprises a screw device arranged for extending or withdrawing a shaft.

7. The device according to claim 1, further comprising:

means for comparing a first actuator position and movement limits with a second actuator position and movement limits and determining which actuator shall be moved.

8. The device according to claim 1, further comprising:

a control unit with a control loop for adjusting a detected deflection error to a given reference using a loop comprising input from a sensed position of at least one said actuator.

9. The device according to claim 8, wherein which control unit comprises an input for a continuous value for a position of at least one actuator.

10. The device according to claim 8, wherein which control unit comprises an input for a value for an actuator position sampled with respect to a time period or a movement increment.

11. The device according to claim 1, wherein said load control device comprises four said actuators arranged on a same side of a spreader.

12. The device according to claim 1, wherein said load control device comprises four said actuators arranged on the boom-tip side of a spreader.

13. The device according to claim 1, wherein said load control device comprises at least one rotary electric motor arranged as drive for at least one actuator to lengthen or shorten a load line.

14. The device according to claim 1, wherein at least one actuator is powered by a motor and comprises a transmission or drive for moving a load line from any of the list of: worm gear, bevel drive, rack-and-pinion.

15. The device according to claim 1, wherein one or more hydraulically powered devices are arranged as drive means or as an actuator for moving a load line and by doing so thus lengthening or shortening the load line.

16. The device according to claim 1, wherein the optical sensor is any from the list of CCD camera, laser scanner, laser rangefinder.

17. The device according to claim 1, wherein the device comprises a plurality of light source arrays comprising a plurality of light sources extending in a plurality of directions on the spreader.

18. A method for controlling a container crane with a suspended load utilizing a load control device, said crane comprising a spreader and load lines arranged in a four point suspension for lifting a load, the method comprising:

sensing with an optical sensor arranged on a trolley of the crane light sources included in at least one light source array arranged on a spreader of the crane extending in at least one direction on the spreader and thereby a deflection position of an orthogonal axis of a container or spreader about an imaginary center line of said orthogonal axis, wherein the optical sensor is arranged in line-of-sight of two or more light sources of the light source array arranged on the spreader in a first straight line relative to an orthogonal axis of the container, wherein the optical sensor is also arranged in line of sight of at least one third light source arranged on a line which is perpendicular to the first straight line, and wherein the at least one third light source is arranged at a different height to the light source of the first straight line, and wherein the deflection position is determined based upon differences in the detection by the optical sensor of the light produced by the light sources, determining a linear position of at least one said actuator, and sending a signal to at least two said actuators to move at least one said suspension point closer to or farther away from said imaginary center line.

19. The method according to claim 18, further comprising:

comparing a first actuator position and actuator movement limits with at least one second actuator position and movement limits and determining which actuator or actuators shall be moved.

20. The method according to claim 18, further comprising:

reeling in one first part of a first load line and, at the same time, letting out one second part of the first load line and so shortening or lengthening a part of the first load line.

21. The method according to claim 20, further comprising:

reeling in in the same positive or negative direction two actuators of a pair of actuators corresponding to one same side of the spreader.

22. The method according to claim 21, further comprising letting out a load line both in the same positive or negative direction two actuators of a pair of actuators corresponding to one same side of the spreader.

23. The method according to claim 18, further comprising:

driving at least one actuator with a motor arranged with a screw device.

24. The method according to claim 23, further comprising:

driving at least one actuator with a motor arranged with a screw device for extending, withdrawing a shaft arranged attached to a load line.

25. The method according to claim 18, further comprising:

continuously determining a position of at least one actuator.

26. The method according to claim 18, further comprising:

determining a position of at least one actuator by means of samples dependent on a time period or a movement increment.

27. The method according to claim 18, further comprising:

measuring with the optical sensor a distance to two or more light sources arranged on the spreader in a first straight line relative to the orthogonal axis of the container.

28. The method according to claim 18, further comprising:

measuring with the optical sensor a distance to two or more light sources arranged in a first straight line on the spreader and measuring any linear deviation from the orthogonal axis in an X or Y direction.

29. The method according to claim 28, further comprising:

measuring with the optical sensor a distance to at least one third light source arranged on a line perpendicular to the first straight line and determining a list error.

30. The method according to claim 29, further comprising:

determining a distance to the at least one third light source, calculating a list deflection of the container, and determining a common movement of a pair one or more said suspension points to correct the list error.

31. The method according to claim 18, further comprising:

measuring a distance to each of the light sources from the optical sensor, measuring a linear deflection, a trim error of the spreader, and determining a common movement of a pair of one or more said suspension points to correct the trim error.

32. The method according to claim 18, further comprising:

controlling said container crane by running one or more computer programs in at least one computer or processor.

33. A computer program product, comprising:

a computer readable medium; and computer program instructions recorded on the computer readable medium and executable by a computer or processor to cause the computer or processor to carry out a method comprising sensing with an optical sensor arranged on a trolley of the crane light sources included in at least one light source array arranged on a spreader of the crane extending in at least one direction on the spreader and thereby a deflection position of an orthogonal axis of a container or spreader about an imaginary center line of said orthogonal axis, wherein the optical sensor is arranged in line-of-sight of two or more light sources of the light source array arranged on the spreader in a first straight line relative to an orthogonal axis of the container, wherein the optical sensor is also arranged in line of sight of at least one third light source arranged on a line which is perpendicular to the first straight line, and wherein the at least one third light source is arranged at a different height to the light source of the first straight line, wherein the deflection position is determined based upon differences in the detection by the optical sensor of the light produced by the light sources, determining a linear position of at least one said actuator, and sending a signal to at least two said actuators to move at least one said suspension point closer to or farther away from said imaginary center line.

34. The method according to claim 18, wherein the suspended load comprises a freight container and the container crane comprises a ship-to-shore container crane.

35. A system for controlling movement of a suspended load of a container crane, said crane comprising a trolley, a spreader and load lines arranged in a four point suspension for lifting a load, the system comprising:

an optical sensor arranged on the trolley to detect light produced by a plurality of light sources included in the at least one light source array arranged in at least one direction on the spreader to sense a deflection position of an orthogonal axis of a container suspended under the spreader with reference to an imaginary center line of said orthogonal axis of the container, wherein the movement deflection is determined based upon differences in the detection by the optical sensor of the light produced by the light sources, and wherein the optical sensor is arranged in line-of-sight of two or more light sources of the light source array arranged on the spreader in a first straight line relative to an orthogonal axis of the container, wherein the optical sensor is also arranged in line of sight of at least one third light source arranged on a line which is perpendicular to the first straight line, and wherein the at least one third light source is arranged at a different height to the light source of the first straight line, two or more actuators arranged attached to at least one load line, wherein the two or more actuators are arranged on the same side of the spreader and a sensor arranged on at least one actuator wherein the sensor is configured to measure a linear movement of the actuator.

36. The system according to claim 35, further comprising:

a sensor configured to determine a linear position of at least one said actuator, and a transmitter configured to send a signal to at least two said actuators to move at least one said suspension point closer to or farther away from said imaginary center line.

37. The system according to claim 35, further comprising:

means for comparing a first actuator position and actuator movement limits with at least one second actuator position and movement limits, and means for determining which actuator or actuators shall be moved.

38. The system according to claim 35, further comprising:

one or more graphical user interfaces for displaying or manipulating data dependent on a linear position or movement of at least one said actuator.

39. The system according to claim 35, wherein at least one sensor is an optical encoder.

40. The system according to claim 39, wherein at least one sensor is an incremental or an absolute encoder.

41. The system according to claim 39, further comprising:

means for generating a signal for any pair of actuators such that each actuator receives a signal for linear movement which has the same value but is of opposite sign.

42. The system according to claim 35, further comprising:

a human-machine interface for a user to monitor or control the suspended load of the container crane, the human-machine interface comprising a graphical user interface comprising means for displaying numerical data dependent on determining a linear position of at least one said actuator, and sending a signal to at least two said actuators to move at least one said suspension point closer to or farther away from said imaginary center line.

43. The system according to claim 42, wherein the graphical user interface further comprises means for displaying the numerical data for speed, and/or position combined on the same display with any from the list of: real time video, graphic representations of the crane, graphic representations parts of the crane, graphic representations of speed and/or position.

44. The system according to claim 42, wherein the graphical user interface further comprises means for providing a display comprising representations of a position and/or speed of the suspended load for the current container comprising any from the group of: real time values, simulated values, previous values.

* * * * *